US008833557B1

(12) United States Patent
Gwynn, Jr. et al.

(10) Patent No.: US 8,833,557 B1
(45) Date of Patent: Sep. 16, 2014

(54) TOOL CARRIER

(71) Applicants: Robert Gwynn, Jr., Roswell, GA (US); Robert Gwynn, III, Roswell, GA (US)

(72) Inventors: Robert Gwynn, Jr., Roswell, GA (US); Robert Gwynn, III, Roswell, GA (US)

( * ) Notice: Subject to any disclaimer, the term of this patent is extended or adjusted under 35 U.S.C. 154(b) by 0 days.

(21) Appl. No.: 14/084,871

(22) Filed: Nov. 20, 2013

(51) Int. Cl.
*B65D 85/28* (2006.01)
*B25H 3/02* (2006.01)

(52) U.S. Cl.
CPC ..... *B25H 3/022* (2013.01)
USPC ..... 206/373; 206/372

(58) Field of Classification Search
USPC ..... 206/349, 372–379, 806; 211/69, 70.6; 312/902; 383/38–40
See application file for complete search history.

(56) References Cited

U.S. PATENT DOCUMENTS

| | | | | | |
|---|---|---|---|---|---|
| 2,697,460 | A * | 12/1954 | Barnett | | 206/349 |
| 3,749,233 | A | 7/1973 | McCormick, Jr. | | |
| 4,210,244 | A | 7/1980 | Westrick | | |
| D257,090 | S | 9/1980 | King, Jr. | | |
| 5,423,404 | A * | 6/1995 | Shaw | | 206/372 |
| 6,126,003 | A * | 10/2000 | Brouard | | 206/372 |
| 6,991,104 | B2 * | 1/2006 | Redzisz | | 206/373 |
| 7,290,651 | B2 * | 11/2007 | Irwin et al. | | 206/373 |
| 7,314,133 | B2 * | 1/2008 | Redzisz | | 206/373 |
| 8,646,602 | B2 * | 2/2014 | Wang | | 206/372 |
| 2005/0167306 | A1 * | 8/2005 | Ho | | 206/373 |
| 2008/0067095 | A1 * | 3/2008 | Mueller | | 206/373 |

* cited by examiner

*Primary Examiner* — Luan K Bui
(74) *Attorney, Agent, or Firm* — Crossley Patent Law; Micah C. Gunn

(57) ABSTRACT

A tool carrier including a base with an elongate vertical backboard body extending from a midline vertical axis of right and left walls of the base and is continuously disposed between first and second top sides of the base. A hinged lid completely separately covers each of the first top side and the second top side to secure items stored in compartments disposed within the base. Vertically oriented pockets on each of front and rear sides of the backboard body releasably secure hand tools therein. Each pocket has an open upper end, an open lower end, a strip member having a pair of spaced apart closed side walls, and a continuous opening between the strip member and the backboard body. The pockets include at least one standalone pocket and at least one row of the pockets. The pockets in each row of pockets are interconnected along the side walls.

8 Claims, 5 Drawing Sheets

TOOL CARRIER

BACKGROUND OF THE INVENTION

Various types of tool boxes and tool bags are known in the prior art. However, what is needed is a tool carrier including a base with a vertical backboard body extending therefrom that divides the base into two sides, various compartments within each side of the base, a hinged lid for the compartments on each side, and vertically oriented pockets for storing hand tools therein.

FIELD OF THE INVENTION

The present invention relates to hand tool storage devices, and more particularly, to a tool carrier.

SUMMARY OF THE INVENTION

The general purpose of the present tool carrier, described subsequently in greater detail, is to provide a tool carrier which has many novel features that result in a tool carrier which is not anticipated, rendered obvious, suggested, or even implied by prior art, either alone or in combination thereof.

To accomplish this, the present tool carrier is primarily vertically oriented to permit the organization of and convenient access to a variety of hand tools and to provide a larger accessible outer surface on which to secure the tools than provided by previously disclosed tool boxes. The present tool carrier includes a base that has a front and a rear wall, a bottom wall, a pentagonal right and left wall, and open first and second top sides. An elongate vertical backboard body extends from a midline vertical axis of the right and left walls and is continuously disposed between the first top side and the second top side in a position perpendicular to the bottom wall. A lid that completely separately covers each of the first top side and the second top side is hingedly attached to the backboard body.

Vertically oriented pockets are disposed on each of the front and rear sides of the backboard body to releasably secure hand tools therein. Each pocket has an open upper end, an open lower end, a strip member having a pair of spaced apart closed side walls, and a continuous opening between the strip member and the backboard body. The pockets include at least one standalone pocket and at least one row of the pockets. The pockets in each row of pockets are interconnected along the side walls of the pockets. Compartments are disposed within the base for the storage of miscellaneous items, such as tape, and hand tool accessories, such as fasteners, drill bills, screws, and wire nuts. An obround aperture is disposed within the backboard body proximal the upper side to form a handle for transport.

Thus has been broadly outlined the more important features of the present tool carrier so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
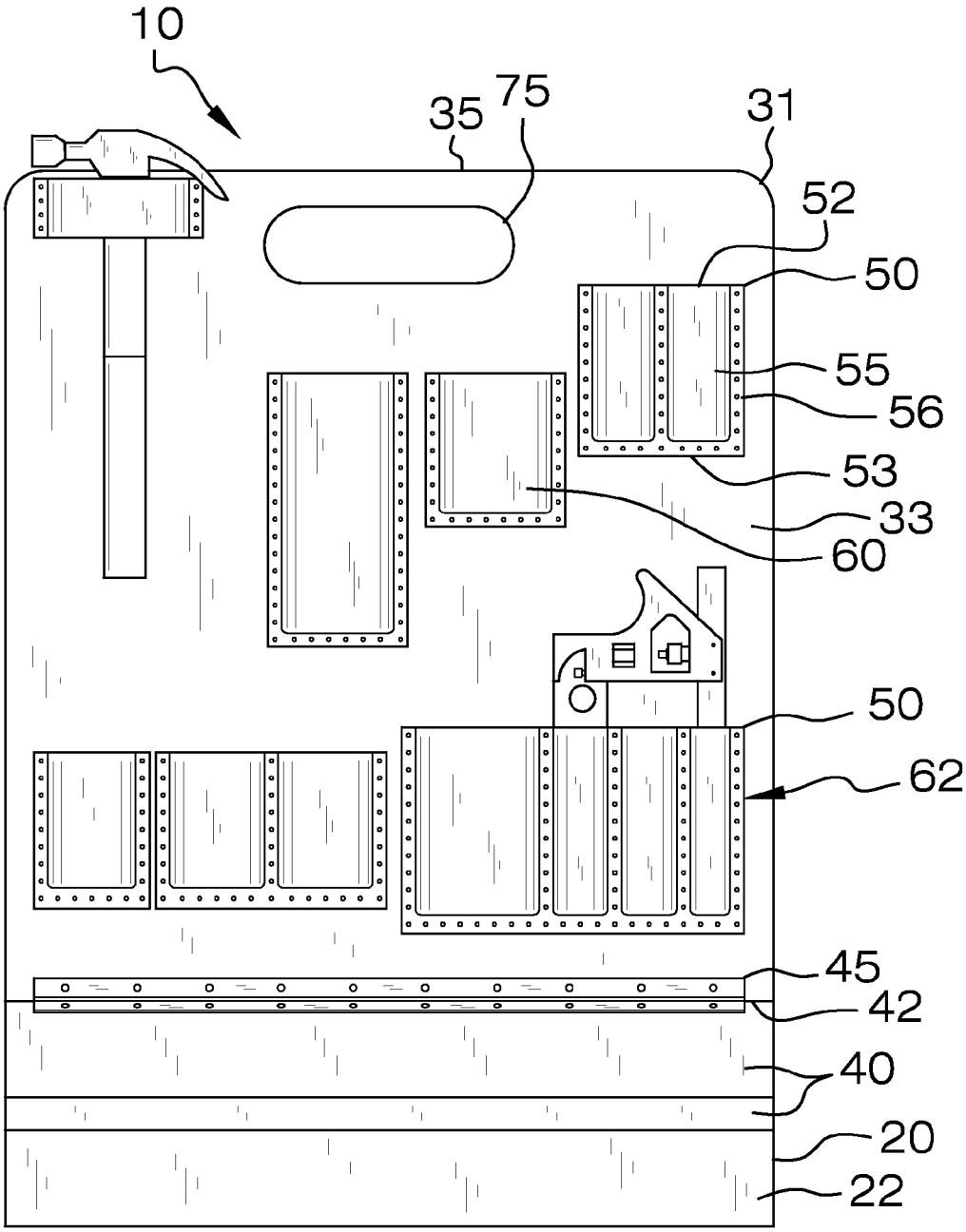
FIG. 1 is an in-use front elevation view.
Figure 2:
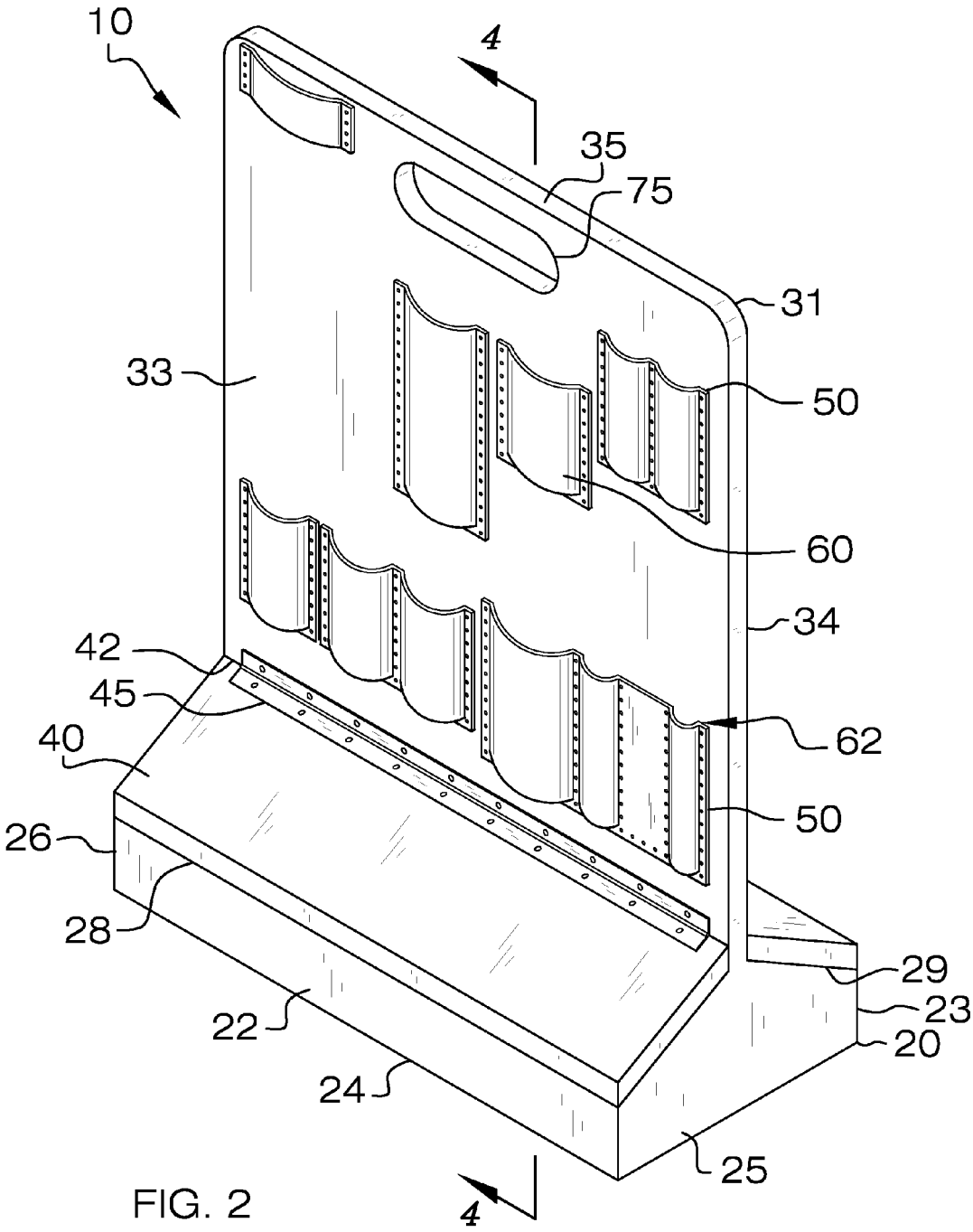
FIG. 2 is a right front isometric view.
Figure 3:
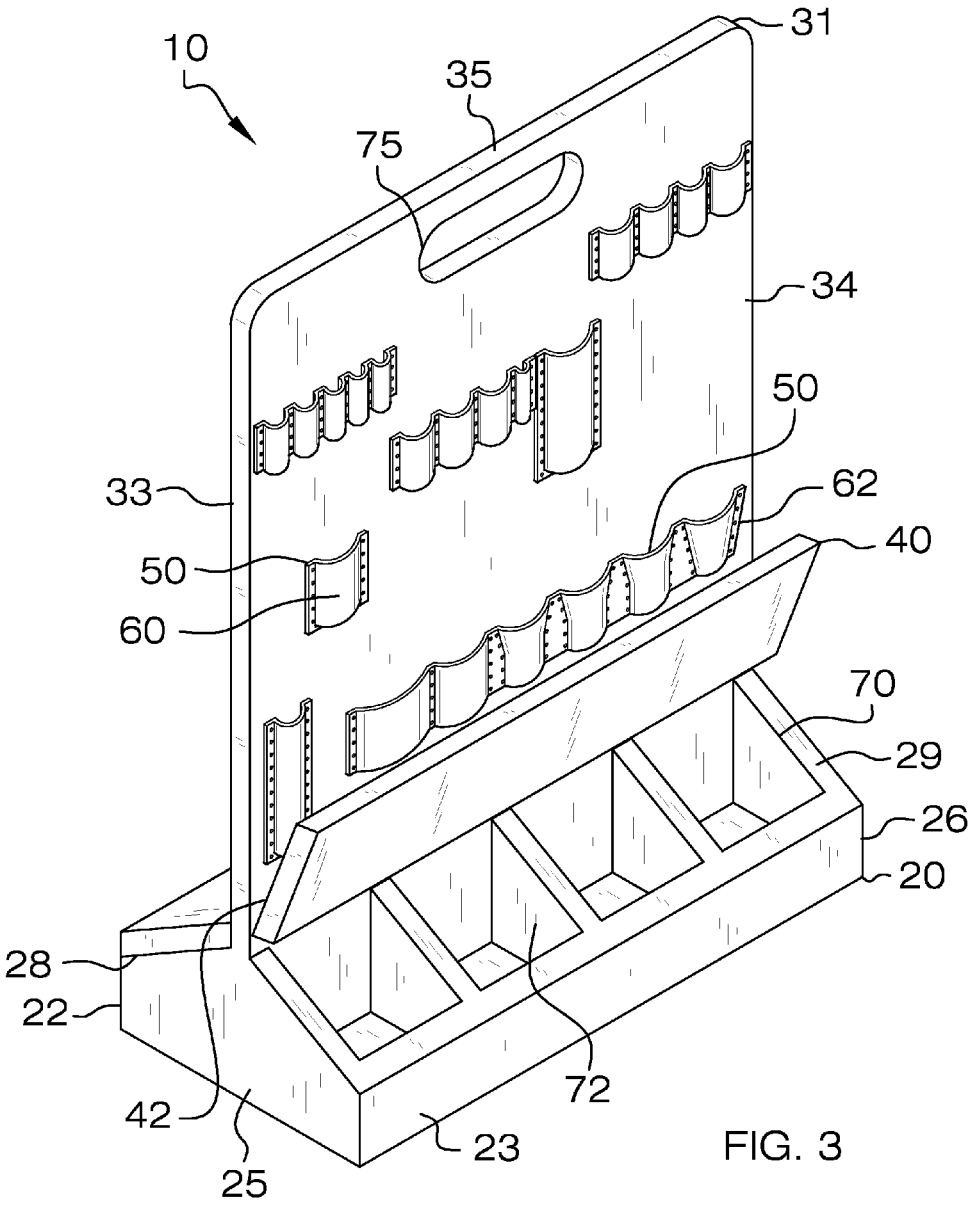
FIG. 3 is a right rear isometric view.
Figure 4:
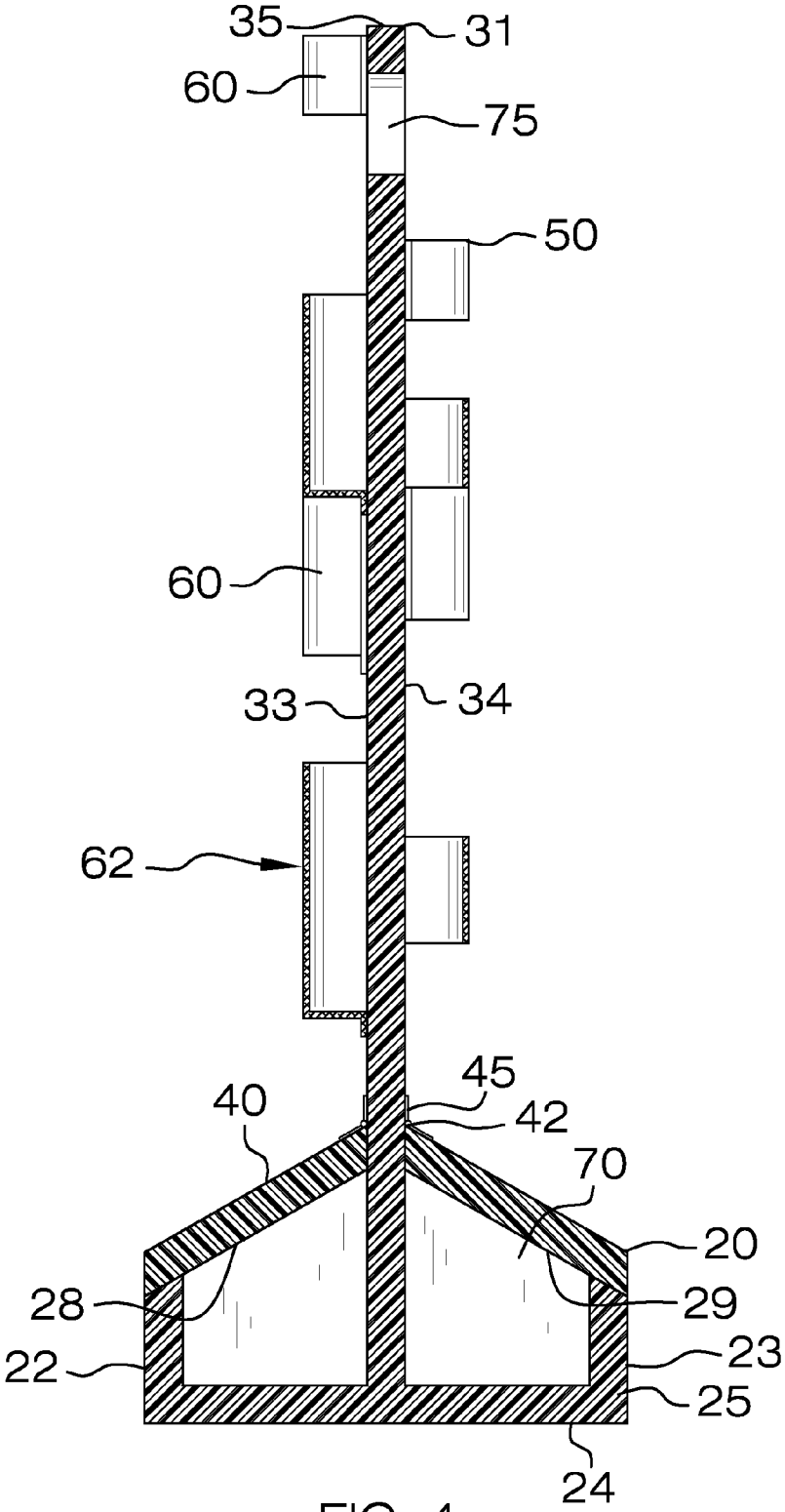
FIG. 4 is a cross-sectional view taken along line 4-4 of FIG. 2.
Figure 5:
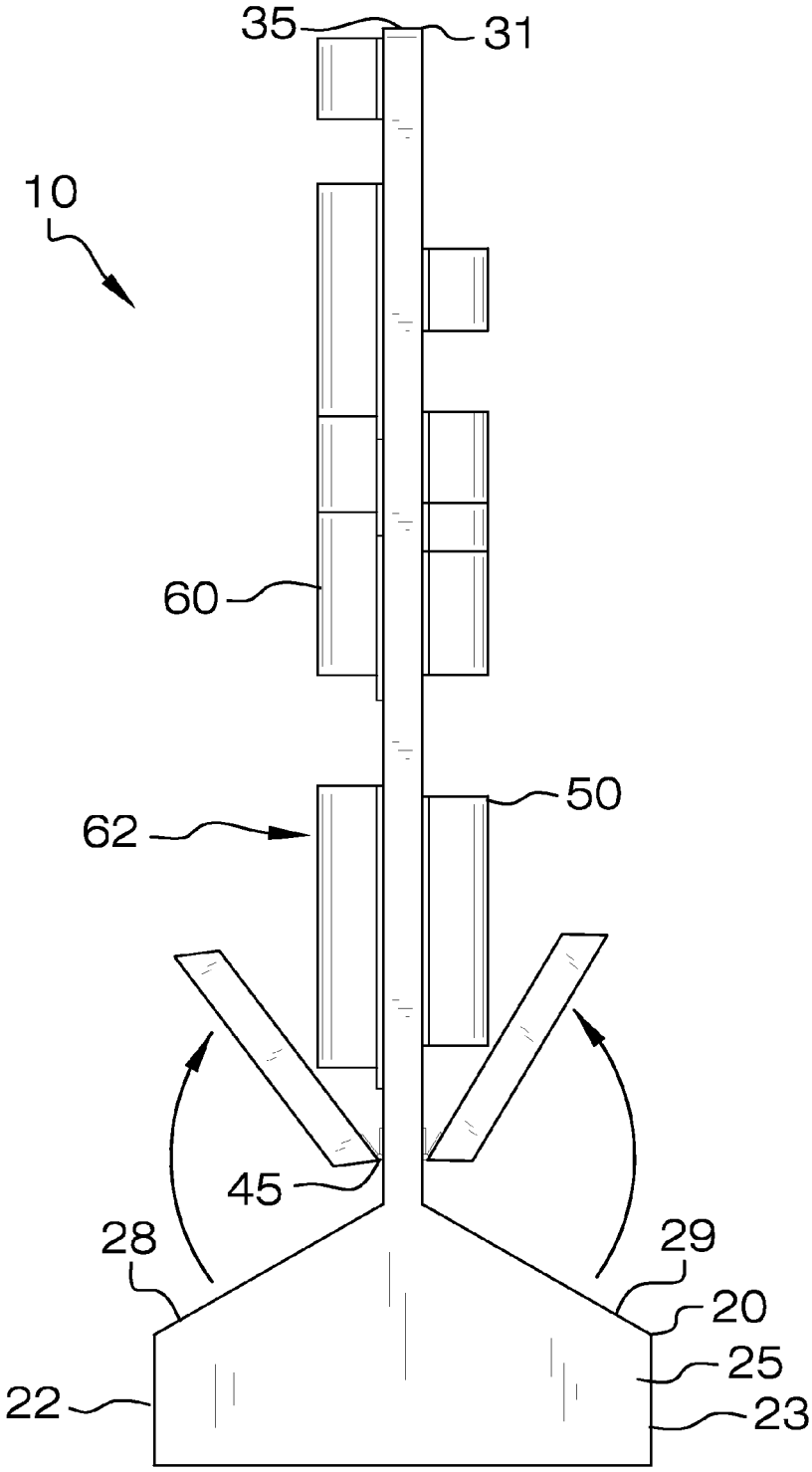
FIG. 5 is a side elevation view.

With reference now to the drawings, and in particular FIGS. 1 through 5 thereof, an example of the instant tool carrier employing the principles and concepts of the present tool carrier and generally designated by the reference number 10 will be described.

Referring to FIGS. 1 through 5, the present tool carrier 10 is illustrated. The tool carrier 10 includes a base 20. The base 20 has a front wall 22, a rear wall 23, a bottom wall 24, a pentagonal right wall 25, and a pentagonal left wall 26. The base 20 also has an open first top side 28 and an open second top side 29. In addition, the base 20 includes an elongate vertical backboard body 31 extending from a midline vertical axis of each of the right wall 25 and the left wall 26. The backboard body 31 is continuously disposed between the first top side 28 and the second top side 29 in a position perpendicular to the bottom wall 24. The backboard body 31 has a front side 33, a rear side 34, and an upper side 35.

A lid 40 completely separately covers each of the first top side 28 and the second top side 29. Each lid 40 has an upper exterior edge 42. A hinge 45 connects the backboard body 31 and the upper exterior edge 42 of each lid 40. A plurality of vertically oriented pockets 50 is disposed on each of the front and rear sides 33, 34 of the backboard body 31 to releasably secure hand tools, such as hammers, screw drivers, pliers, scraping tools, putty knives, cutting implements, wrenches, packaged Allen wrenches, therein. Each pocket 50 has an open upper end 52, an open lower end 53, a strip member 55 having a pair of spaced apart closed side walls 56, and a continuous opening 58 between the strip member 55 and the backboard body 31. The pockets 50 include at least one standalone pocket 60 and at least one row of the pockets 62. The pockets 50 in each row of pockets 62 are interconnected along the side walls 56. All of the pockets 50 in each row of the pockets 62 have the same dimensions; however, the pockets 50 in each row of pockets 62 have dimensions different from the dimensions of the pockets 50 in every other row of pockets 62. Thus, the pockets 50 in each row of pockets 62 are configured to releasably secure a set of a same type of hand tool. For example, a set of screwdrivers are secured in one row of the pockets 62, a set of wrenches are secured in a separate row of the pockets 62, and a set of pliers are secured in yet another row of pockets 62.

A plurality of compartments 70 is disposed within the base 20. Each compartment 70 is defined by the backboard body 31, a respective one of the front and rear walls 22, 23 of the base 20, the respective first and second top side 28, 29, and one of a divider 72 and a respective one of the right and left walls 25, 26 of the base 20. All of the compartments 70 can have the same dimensions, as illustrated. The compartments 70 are provided for the storage of miscellaneous items, such as tape, and hand tool accessories, such as fasteners, drill bills, screws, and wire nuts.

An obround aperture 75 is disposed within the backboard body 31 proximal the upper side 35 to form a handle by which to carry the device 10.

The base 20 has a maximum width in the range of 15 inches to 25 inches, a maximum height in the range of 20 inches to 34 inches, and a maximum depth of 6 inches to 12 inches. These dimensions preserve the primary vertical orientation of the device for organizing hand tools to provide convenient access to the tools, while also permitting convenient storage of the device 10 in a variety of places as a closet, a workshop, in a truck, and a back seat of an automobile.

What is claimed is:

1. A tool carrier comprising:

a base comprising:

a front wall, a rear wall, a bottom wall, a right wall, and a left wall;

an open first top side;

an open second top side;

a vertical backboard body continuously disposed between the first top side and the second top side, the backboard body disposed in a position perpendicular to the bottom wall, the backboard body having a front side, a rear side, and an upper side;

a lid hingedly connected to the backboard body at an upper exterior edge of each lid;

a plurality of vertically oriented pockets disposed on each of the front and rear sides of the backboard body;

a plurality of compartments disposed within the base; and an aperture disposed within the backboard body proximal the upper side.

2. A tool carrier comprising:

a base comprising:

a front wall, a rear wall, a bottom wall, a pentagonal right wall, and a pentagonal left wall;

an open first top side;

an open second top side;

a vertical backboard body extending from a midline vertical axis of each of the right wall and the left wall, the backboard body continuously disposed between the first top side and the second top side in a position perpendicular to the bottom wall, the backboard body having a front side, a rear side, and an upper side;

a lid completely covering each of the first top side and the second top side, each lid having an upper exterior edge;

a hinge connected to backboard body and the upper exterior edge of each lid;

a plurality of vertically oriented pockets disposed on each of the front and rear sides of the backboard body, each pocket having an open upper end, an open lower end, a strip member having a pair of spaced apart closed side walls, a continuous opening between the strip member and the backboard body;

a plurality of compartments disposed within the base, each compartment defined by the backboard body, a respective one of the front wall and the rear wall of the base, the respective first top side and an open second top side, and one of a divider and a respective one of the right wall and the left wall of the base; and an obround aperture disposed within the backboard body proximal the upper side, the aperture configured to form a handle disposed within the backboard body.

3. The tool carrier of claim 2 wherein the pockets comprise at least one standalone pocket and at least one row of the pockets, wherein the pockets in each row of pockets are interconnected along the side walls.

4. The tool carrier of claim 3 wherein all of the pockets in each row of the pockets have the same dimensions.

5. The tool carrier of claim 4 wherein the pockets in each row of pockets have dimensions different from the dimensions of the pockets in every other row of pockets.

6. The tool carrier of claim 5 wherein the pockets in each row of pockets are configured to releasably secure a same type of hand tool.

7. A tool carrier comprising:

a base comprising:

a front wall, a rear wall, a bottom wall, a pentagonal right wall, and a pentagonal left wall;

an open first top side;

an open second top side;

an elongate vertical backboard body extending from a midline vertical axis of each of the right wall and the left wall, the backboard body continuously disposed between the first top side and the second top side in a position perpendicular to the bottom wall, the backboard body having a front side, a rear side, and an upper side;

a lid completely covering each of the first top side and the second top side, each lid having an upper exterior edge;

a hinge connected to backboard body and the upper exterior edge of each lid;

a plurality of vertically oriented pockets disposed on each of the front and rear sides of the backboard body, each pocket having an open upper end, an open lower end, a strip member having a pair of spaced apart closed side walls, a continuous opening between the strip member and the backboard body;

a plurality of compartments disposed within the base, each compartment defined by the backboard body, a respective one of the front wall and the rear wall of the base, the respective first top side and an open second top side, and one of a divider and a respective one of the right wall and the left wall of the base; and an obround aperture disposed within the backboard body proximal the upper side, the aperture configured to form a handle disposed within the backboard body;

wherein the pockets comprise at least one standalone pocket and at least one row of the pockets, wherein the pockets in each row of pockets are interconnected along the side walls;

wherein all of the pockets in each row of the pockets have the same dimensions;

wherein the pockets in each row of pockets have dimensions different from the dimensions of the pockets in every other row of pockets;

wherein the pockets in each row of pockets are configured to releasably secure a same type of hand tool.

8. The tool carrier of claim 7 wherein all of the compartments have the same dimensions.

* * * * *